US007592605B2

(12) United States Patent
Weisner et al.

(10) Patent No.: US 7,592,605 B2
(45) Date of Patent: Sep. 22, 2009

(54) RADIOISOTOPE GENERATOR AND METHOD OF CONSTRUCTION THEREOF

(75) Inventors: Peter Stewart Weisner, Amersham (GB); Terence Robert Frederick Forrest, Amersham (GB)

(73) Assignee: GE Healthcare Limited, Buckinghamshire (GB)

( * ) Notice: Subject to any disclaimer, the term of this patent is extended or adjusted under 35 U.S.C. 154(b) by 448 days.

(21) Appl. No.: 10/511,405

(22) PCT Filed: Dec. 11, 2002

(86) PCT No.: PCT/GB02/05604

§ 371 (c)(1),
(2), (4) Date: Oct. 12, 2004

(87) PCT Pub. No.: WO03/088269

PCT Pub. Date: Oct. 23, 2003

(65) Prior Publication Data

US 2005/0253085 A1 Nov. 17, 2005

(30) Foreign Application Priority Data

Apr. 11, 2002 (GB) ..... 0208356.6

(51) Int. Cl.
*G21G 1/00* (2006.01)

(52) U.S. Cl. ..... 250/432 PD; 250/505.1; 250/506.1; 250/507.1; 422/159; 422/261; 422/284; 422/976

(58) Field of Classification Search ..... 250/505.1, 250/506.1, 507.1, 432 PD; 422/159, 261, 422/284, 976

See application file for complete search history.

(56) References Cited

U.S. PATENT DOCUMENTS 3,535,085 A 10/1970 Shumate
3,564,256 A 2/1971 Nonhebel
3,655,981 A 4/1972 Montgomery et al.
3,898,044 A * 8/1975 Strecker et al. ..... 422/159

(Continued)

FOREIGN PATENT DOCUMENTS

FR 2041587 1/1971
FR 2194021 2/1974

OTHER PUBLICATIONS

Lu, et al ("Characterization of close-celled cellular aluminum alloys" Journal of Materials Science 36(2001) 2773-2786.).*
International Search Report for WO03/088269 dated Oct. 22, 2003.
Search Report for GB 0208356.6 dated Dec. 9, 2002.
IPER for PCT/GB02/05604 dated Sep. 21, 2004.
Written Opinion for PCT/GB02/05604 dated May 11, 2004.

*Primary Examiner*—David A Vanore
*Assistant Examiner*—Michael Maskell
(74) *Attorney, Agent, or Firm*—Robert F. Chisholm

(57) ABSTRACT

A device for producing a fluid containing a radioactive constituent, comprising a shielded chamber (5) with an opening for receiving an isotope container (6) housing a radioactive isotope (7); a chamber closure (18) adapted for cooperating with and closing the chamber opening; a first fluid port comprising a first hollow needle projecting into the shielded chamber from the chamber closure for fluid communication with the isotope container; a second fluid port comprising a second hollow needle projecting into the shielded chamber from the closed end of the chamber opposite the chamber closure for fluid communication with the isotope container; first and second compressible buffers (28, 29) mounted so as to surround at least partially the respective first and second hollow needles (12, 13), each buffer providing an outer surface for contact with opposed ends of the isotope container; and a spacer of a predetermined thickness associated with one or each of the first and second compressible buffers for determining the positioning of the isotope container within the shielded chamber.

16 Claims, 1 Drawing Sheet

U.S. PATENT DOCUMENTS 3,946,238 A 3/1976 Fries
3,970,583 A 7/1976 Panek-Finda
4,188,539 A 2/1980 Strecker
4,387,303 A * 6/1983 Benjamins ..... 250/432 PD
4,582,638 A * 4/1986 Homer et al. ..... 588/16
4,801,047 A 1/1989 Klatte et al.
4,871,087 A * 10/1989 Johnson ..... 222/1
5,442,186 A * 8/1995 Walker et al. ..... 250/506.1
6,157,036 A * 12/2000 Whiting et al. ..... 250/432 PD
7,060,998 B2 * 6/2006 Forrest et al. ..... 250/506.1

* cited by examiner

RADIOISOTOPE GENERATOR AND METHOD OF CONSTRUCTION THEREOF

This application is a filing under 35 U.S.C. 371 of international application number PCT/GB02/05604, filed Dec. 11, 2002, which claims priority to application number 0208356.6 filed Apr. 11, 2002, in Great Britain the entire disclosure of which is hereby incorporated by reference

FIELD OF INVENTION

The present invention relates to a radioisotope generator of the type commonly used to generate radioisotopes such as metastable technetium-99m ($^{99m}$Tc) and to a method of construction of the radioisotope generator.

BACKGROUND OF THE INVENTION

The diagnosis and/or treatment of disease in nuclear medicine constitute one of the major applications of short-lived radioisotopes. It is estimated that in nuclear medicine over 90% of the diagnostic procedures performed worldwide annually use $^{99m}$Tc labelled radio-pharmaceuticals. Given the short half-life of radio-pharmaceuticals, it is helpful to have the facility to generate suitable radioisotopes on site. Accordingly, the adoption of portable hospital/clinic size $^{99m}$Tc generators has greatly increased over the years. Portable radioisotope generators are used to obtain a shorter-lived daughter radioisotope which is the product of radioactive decay of a longer-lived parent radioisotope, usually adsorbed on a bed in an ion exchange column. Conventionally, the radioisotope generator includes shielding around the ion exchange column containing the parent radioisotope along with means for eluting the daughter radioisotope from the column with an eluate, such as saline solution. In use, the eluate is passed through the ion exchange column and the daughter radioisotope is collected in solution with the eluate, to be used as required.

In the case of $^{99m}$Tc, this radioisotope is the principle product of the radioactive decay of $^{99}$Mo. Within the generator, conventionally the $^{99}$Mo is adsorbed on a bed of aluminium oxide and decays to generate $^{99m}$Tc. As the $^{99m}$Tc has a relatively short half-life it establishes a transient equilibrium within the ion exchange column after approximately twenty-four hours. Accordingly, the $^{99m}$Tc can be eluted daily from the ion exchange column by flushing a solution of chloride ions, i.e. sterile saline solution through the ion exchange column. This prompts an ion exchange reaction, in which the chloride ions displace $^{99m}$Tc but not $^{99}$Mo.

In the case of radio-pharmaceuticals, it is highly desirable for the radioisotope generator to be constructed and used under aseptic conditions i.e. there should be no ingress of bacteria into the generator. Moreover, due to the fact that the isotope used in the ion exchange column of the generator is radioactive, and is thereby extremely hazardous if not handled in the correct manner, the radioisotope generator also should be constructed and used under radiologically safe conditions.

In trying to ensure adequate radiological protection, some known radioisotope generators have tended to be of a complicated construction incorporating a large number of components and requiring the ion exchange column to be introduced early on in the construction of the generator. This means that there is a lengthy period during construction when the radioisotope generator and those constructing the generator are unnecessarily exposed to radiation. Such complex structures also add to the cost of the generator. It is thus important that the actual construction of the generator is reliable and limits the extent to which the generator and those constructing the generator are exposed to radiation during construction.

U.S. Pat. No. 3,946,238 describes a shielded radioisotope generator comprising a cylindrical shielded housing for a central repository. The repository is bound by a removable top cover and side walls and a base which are made from lead and which act as the shielding. Within the repository a bottle is provided which contains an ion exchange column on which $^{99}$Mo is absorbed. In this document the construction of the generator is almost completed before the ion exchange column is introduced to the repository. However, the eluate is introduced to/removed from the ion exchange column of the generator via apertures in the walls of the bottle. Thus, although the construction of the generator limits the exposure to radiation during construction, the eluate is introduced and extracted using only a pipette which is highly undesirable as it means that the users of the generator are exposed to radiation each time (i.e. once ever twenty-four hours) the radioisotope is extracted. Moreover, this arrangement provides no means for accurately controlling the flow of eluate.

U.S. Pat. No. 3,564,256 describes a radioisotope generator in which the ion exchange column is in a cylindrical holder which is located within two box-shaped elements that are in turn located within appropriate radiation shielding. The holder is closed by rubber plugs at both ends, and the box-shaped elements have passages opposite each of the rubber plugs in which respective needles are located. At the outermost ends of the needles quick-coupling members are provided to enable a syringe vessel containing a saline solution to be connected to one of the needles and to enable a collection vessel to be connected to the other of the two needles. It is self-evident that the box-shaped elements and the radiation shielding must be constructed around the holder containing the ion exchange column. Therefore, throughout the construction of the generator all parts of the generator and those constructing the generator will, of necessity, be exposed to radiation. Furthermore, although reference is made to needles being used to pierce the rubber plugs at each end of the holder, this generator construction provides no means for controlling the penetration of the needles through the plugs.

U.S. Pat. No. 4,387,303 describes a radioisotope generator comprising a column having an eluent inlet aperture and an eluate outlet aperture and containing an ion exchange bed with the parent radioisotope. Both the eluent inlet and eluate outlet are in communication with channels in the surrounding shielding for the introduction and removal of eluate to and from the ion exchange column. Although no information is provided with regard to the construction of the generator, it is evident that the shielding must be constructed around the ion exchange column as accurate alignment of the channels in the shielding with the inlet and outlet of the ion exchange column is essential. Thus, here too, during construction all parts of the generator and those constructing the generator will be exposed to radiation from the ion exchange column.

U.S. Pat. No. 4,801,047 describes a dispensing device for a radioisotope generator in which the vial containing the saline solution that will be used to flush out the desired radioisotope from the ion exchange column, is mounted in a carrier that is moveable relative to the hollow needle used to pierce the seal of the vial and to extract the saline solution. This construction is described as providing control of the amount of saline solution removed from the vial.

SUMMARY OF THE INVENTION

The present invention seeks to provide a radioisotope generator and a method of construction of the generator that is simple in construction but which ensures the necessary degree of sterility and radiological protection is provided during construction.

In accordance with the present invention, there is provided a device for producing a fluid containing a radioactive constituent, the device comprising a shielded chamber with an opening for receiving an isotope container housing a radioactive isotope; a chamber closure adapted for cooperating with and closing the chamber opening; a first fluid port comprising a first hollow needle projecting into the shielded chamber from the chamber closure for fluid communication with the isotope container; a second fluid port comprising a second hollow needle projecting into the shielded chamber from the closed end of the chamber opposite the chamber closure for fluid communication with the isotope container; first and second compressible buffers mounted so as to surround at least partially the respective first and second hollow needles, each buffer providing an outer surface for contact with opposed ends of the isotope container; and a spacer of a predetermined thickness associated with one or each of the first and second compressible buffers for determining the positioning of the isotope container within the shielded chamber.

Preferably, with the chamber closure in place in the chamber opening, the first and second hollow needles are fixed in position at each end of the shielded chamber and ideally the spacer is provided with the second compressible buffer at the closed end of the shielded chamber.

In a preferred embodiment the material of the first and second compressible buffers is a semi-open cell foam whereas the material of the spacer is a closed cell foam.

Furthermore, the isotope container is preferably an ion exchange column and each of its opposing ends preferably includes a frangible seal adapted to be pierced by and to seal around the respective first and second hollow needles.

In the preferred embodiment the first and second hollow needles are each connected via associated fluid conduits with a fluid inlet and a fluid outlet respectively with the fluid inlet and the fluid outlet ideally consisting of hollow spikes. Also, the device preferably further includes an outer housing within which the shielded chamber is located wherein the fluid inlet and the fluid outlet are mounted in the outer housing to provide fluid connections external to the outer housing.

The fluid conduits may each consist of flexible tubing which is greater in length than the distance between the hollow needles and their respective fluid inlet or outlet.

In a further aspect the present invention provides a method of constructing a radioisotope generator comprising the steps of: providing a shielded chamber with an opening and a chamber closure adapted for cooperating with and closing the chamber opening; providing a first fluid port comprising a first hollow needle projecting into the shielded chamber from the chamber closure; providing a second fluid port comprising a second hollow needle projecting into the shielded chamber at the end of the chamber opposite the opening; mounting first and second compressible buffers so as to surround at least partially the respective first and second hollow needles, one or each of the compressible buffers including a spacer of predetermined thickness; thereafter introducing an isotope container housing a radioactive isotope through the chamber opening into the shielded chamber so as to contact with the second hollow needle and the second compressible buffer at the closed end of the chamber; and closing the shielded chamber by positioning the chamber closure in the opening and bringing the first hollow needle and the first compressible buffer into contact with the isotope container whereby the spacer determines the positioning of the isotope container within the shielded container.

Preferably the method further comprises the steps of, prior to introduction of the isotope container into the shielded chamber, connecting the first hollow needle to a first fluid conduit; connecting the second hollow needle to a second fluid conduit; locating the shielded container within an outer housing and connecting the first fluid conduit to a fluid inlet in the outer housing and the second fluid conduit to a fluid outlet in the outer housing.

Ideally, the first and second fluid conduits are each of flexible tubing which is greater in length than the distance between the first and second hollow needles and their respective fluid inlet and fluid outlet when the chamber closure is in place in the chamber opening and the shielded chamber is positioned within the outer housing whereby all fluid connections can be established prior to installation of the isotope container within the shielded chamber.

DETAILED DESCRIPTION OF THE PREFERRED EMBODIMENTS OF THE INVENTION

Figure 1:
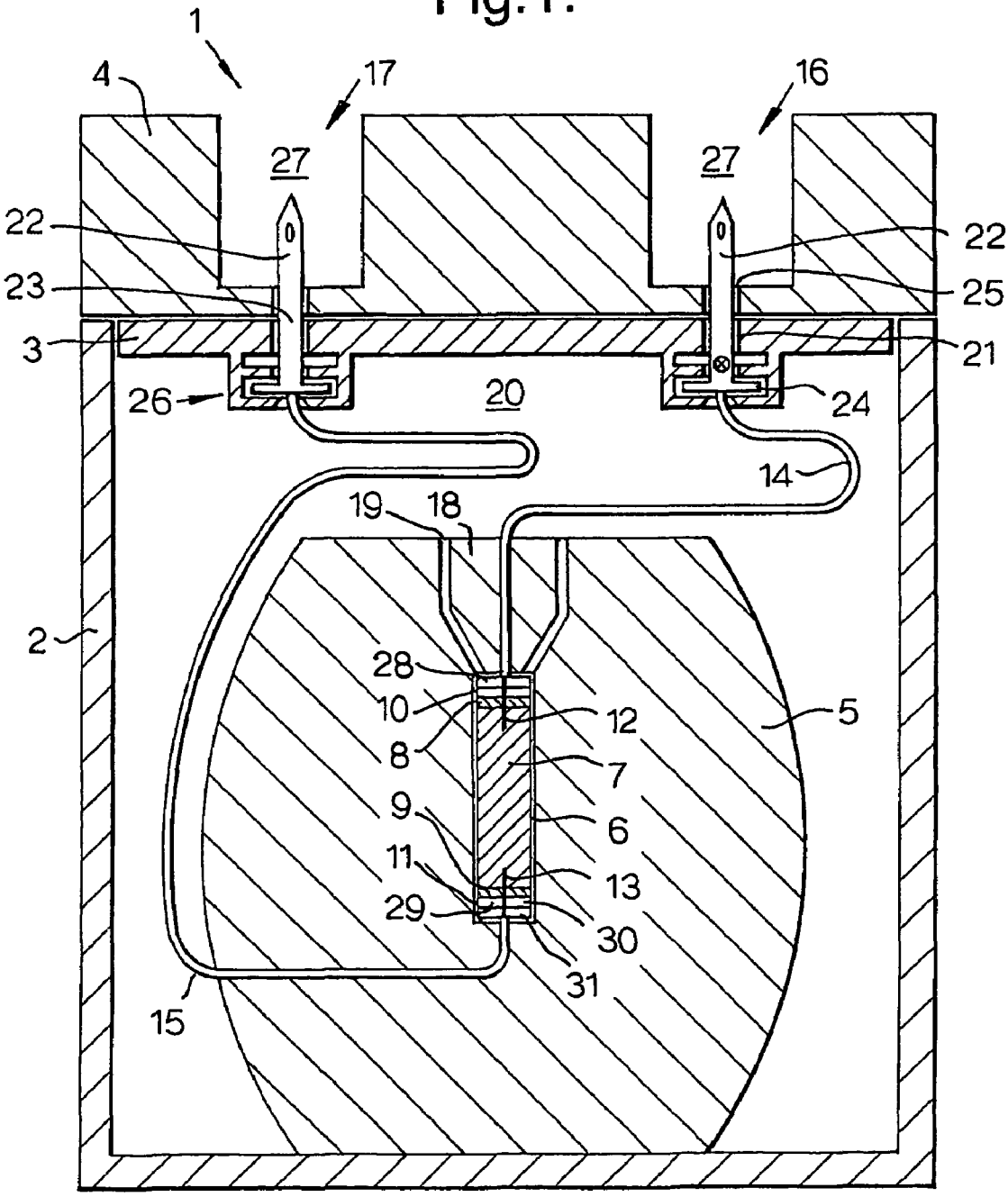
FIG. 1 depicts a radioisotope generator of the present invention.

An embodiment of the present invention will now be described, by way of example only, with reference to FIG. 1 which illustrates a radioisotope generator having fluid connections to the ion exchange column in accordance with the present invention.

FIG. 1 illustrates a radioisotope generator 1 comprising an outer container 2, a top plate 3 which is sealingly secured to the outer container 2, and a separate top cover 4 which is secured to the outer container 2 over the top plate 3. Inside the outer container 2 an inner shielded container 5, providing shielding against radiation, is located which is preferably, but not exclusively, made from either lead or a depleted uranium core within a stainless steel shell. The shielded container 5 surrounds a tube 6 containing an ion exchange column 7. The molybdenum, in the form of its radioactive isotope $^{99}$Mo, is adsorbed on to the ion exchange column 7. The tube 6 containing the ion exchange column has frangible rubber seals 8 and 9 at opposing ends 10 and 11 which, as illustrated, when in use are pierced by respective hollow needles 12 and 13.

Each of the hollow needles 12 and 13 is in fluid communication with a respective fluid conduit 14, 15 that are in turn in fluid communication respectively with an eluent inlet 16 and an eluate outlet 17. The fluid conduits 14, 15 are preferably flexible plastic tubing. The tubing 14, extending from the hollow needle 12, passes through a channel in a container plug 18, that closes the upper opening 19 to the shielded container 5, and then extends from the container plug 18 to the eluent inlet 16. The tubing 15, extending from the hollow needle 13, passes through a channel in the shielded container 5 to the eluate outlet 17. The inner shielded container 5 is smaller than the outer container 2 and so there is a free space 20 within the outer container 2 above the shielded container 5. This free space 20 accommodates part of the tubing 14, 15 extending from the hollow needles to the eluent inlet and eluate outlet as the lengths of the tubing 14, 15 are both much greater than the minimum length required to connect the hollow needles 12, 13 with the respective eluent inlet 16 and eluate outlet 17 and their length may be approximately twice the distance to the respective inlet and outlet.

The top plate 5 of the radioisotope generator 1 has a pair of apertures 21 through which respective eluent inlet and outlet components project. The eluent inlet and eluate outlet components are each hollow spikes 22 though in the case of the inlet component the hollow spike has two holes, one for the passage of fluid and one that is connected to a filtered air inlet. The hollow spike 22 consists of an elongate generally cylindrical spike body 23 and an annular retaining plate 24 which is attached to or is moulded as a single part with one end of the spike body 23. The opposing end of the spike body 23 is shaped to a point and has an aperture communicating with the interior of the spike body adjacent the point. This pointed end of the spike body 23 is shaped so that it is capable of piercing a sealing membrane of the type commonly found with sample vials. The annular retaining plate 24 forms a skirt projecting outwardly from the spike body 23 and may be continuous around the spike body or discontinuous in the form of a plurality of discrete projections.

The top cover 4 of the radioisotope generator 1 also includes a pair of apertures 25 arranged so as to align with the apertures 21 in the top plate 3 and shaped to allow through passage of the spike body 23. Thus, each of the hollow spikes 22 is arranged to be held and supported by its annular retaining plate 24 by component supports 26 provided on the inside of the top plate 3 whilst the hollow spike body 23 projects through the apertures in both the top plate 3 and the top cover 4 to the exterior of the outer container 2. Each one of the apertures 25 in the top cover 4 is located at the bottom of a well 27 that is shaped to receive and support either an isotope collection vial or a saline supply vial. Thus, both vials are housed outside of the outer container 2 and are not exposed to radiation from the ion exchange column 7.

In order to supply the ion exchange column with the chloride ions required for elution of the radioisotope, saline solution is drawn through the ion exchange column 7, by establishing a pressure differential across the ion exchange column. This is accomplished by connecting a saline supply vial to the eluent inlet 16 which is in fluid communication with the top end 10 of the ion exchange column 7 via the tubing 14 and hollow needle 12 and connecting an evacuated collection vial to the eluate outlet 17 which is in fluid communication with the bottom end 11 of the ion exchange column 7 via the tubing 15 and hollow needle 13. The pressure differential is established by virtue of the fluid pressure of the saline in the supply vial and the extremely low pressure in the evacuated collection vial. This urges passage of the saline solution through the ion exchange column 7 to the collection vial carrying with it the daughter radioisotope.

This process enables the radioactive isotope to be collected without either the outer container 2 or the inner shielded container 5 being opened. In this way radiological protection and aseptic conditions of the isotope generator 1 can be maintained during use. Of course, in the event of failure of the eluate path from the eluent inlet 16 to the eluate outlet 17 repairs would involve the opening of at least the outer container 2 and in all probability the inner shielded container 5 also. In practice such repairs are not undertaken because of the radiation exposure that would ensue. Therefore the reliability of the eluate path is extremely important. Existing radioisotope generators have sought to address this problem through complex designs in which the fluid path from the eluent inlet to the eluate outlet are 'hard-wired'. That is to say the fluid connections are established during the actual construction of the generator. Such designs, though, have the disadvantage not only of complexity but also the exposure to radiation that results from the generator having to be built around the ion exchange column.

The radioisotope generator illustrated in FIG. 1 has been designed to improve the reliability of the eluate path whilst minimising the radiation exposure during construction of the generator. In particular, the construction of the generator involves initially establishing the fluid connection between the hollow needle 13 and the tubing 15 that passes through the shielded container 5 and connecting the tubing 15 to the eluate outlet 17. The top plate 3 and the top cover 4 along with the hollow spikes 22 are connected together and are ready for closing the outer container 2. Similarly, with the container plug 18 free from the opening 19 of the shielded container 5, the fluid connections of the tubing 14 with the eluent inlet and the hollow needle 12 are established with the hollow needle 12 projecting outwardly from the inner end of the container plug 18. The need for the greater lengths of tubing 14, 15 is now apparent as the tubing must be sufficiently long to enable the top plate 3 to be kept clear of the opening to the outer container 2 even after the fluid path has been established. Of course, in addition or as an alternative the tubing could be formed of a resilient or elastic material which permits the tubing to be stretched when the top plate is held away from the opening of the outer container 2. During all of this construction the tube 6 containing the ion exchange to column 7 is not in place within the shielded container 5.

Once all construction of the generator 1 is completed, and the only remaining steps are the closure of the inner shielded container 5 and the outer container 2, the tube 6 containing the ion exchange column 7 is inserted into the interior of the shielded container 5. This insertion of the tube may be performed using a robotic arm so as to minimise the extent of any radiation exposure. The opening 19 of the shielded container 2 to the interior space that is to accommodate the tube 6 includes a frusto-conical wall which assists in guiding and aligning the outlet end 11 of the tube 6 in position above the hollow needle 13 at the base of the substantially cylindrical interior space defined by the inner walls of the shielded container 5. Further lowering of the tube 6 down into the interior space results in the tip of the hollow needle 13 contacting and piercing the bottom seal 9 of the tube 6. Further lowering of the tube 6 ensures that the hollow needle 13 penetrates sufficiently into the interior of the tube 6 that the aperture in the tip of the needle 13 is positioned wholly within the tube 6.

With the tube 6 now in position within the shielded container 5 the container plug 18 is inserted into the opening 19 of the shielded container 5 to close the shielded container. In the process of positioning the plug 18 into the opening 19 of the shielded container 5 the tip of the hollow needle 12 contacts and then pierces the seal 8 at the top end 10 of the tube 6 to penetrate the interior of the tube. Once the plug 18 is in position, sealing the opening 19 of the shielded container 5, the aperture in the tip of the hollow needle 12 is positioned wholly within the tube 6. There is a risk during this procedure of the hollow needles 12, 13 failing to penetrate far enough into the tube 6 to reliably ensure that the apertures in the tips of the needles are wholly within the tube.

To prevent such an occurrence compressible disks 28, 29 are mounted about their respective needles 12, 13. The compressible disk 28 surrounding the upper hollow needle 12 is preferably made of a semi-open cell foam such as polyether and has a cross-section conforming to the cross-section of the interior space of the shielded container 5. The compressible disk 28 therefore acts to provide a protective sleeve to the hollow needle 12 before the needle is inserted into the tube 6 and also cushions the engagement of the container plug 1 8 with the top of the tube 6. The compressible disk 29, which also has a cross-section corresponding to the interior space of the shielded container 5, similarly acts as a protective sleeve about the hollow needle 13 in the base of the interior space into which the tube 6 is inserted. This compressible disk 29 is preferably formed of two separate layers, the first layer 30, adjacent the tip of the needle, is preferably of the same open cell foam as the compressible disk 28. The second layer 31, distant from the tip of the needle, is preferably of a closed cell foam such as polyethylene and is less compressible than the first layer 30. The thickness of this second layer is carefully selected with respect to the length of the needle 13 so that when the tube 6 is lowered over the needle, the needle penetrates a predetermined amount into the tube 6. By accurately controlling the extent of penetration of the needle 13 through the lower seal 9 of the tube, the extent of penetration of the needle 12 through the upper seal 8 can thereby also be controlled. Thus careful selection of the compressibility and the thickness of the two disks the fluid path ensures that the path from the eluent inlet to the eluate outlet can be reliably established in a construction process that minimises the extent of radiation exposure to which the generator is subjected. For example, both discs may consist of a 12.5 mm diameter cylinder comprising a 8 mm long cross-linked polyethylene closed cell foam of density 45 Kg/cubic meter laminated to a 16 mm long polyether semi-open cell foam of density 30 Kg/cubic meter.

Thus, with the embodiment of the radioisotope generator described above, the constructional elements of the generator can each be rendered sterile and confined to a sterile environment during construction. Furthermore, during construction the radioactive material, which is confined within a sealed tube, is only introduced at the end of the construction process thereby minimising the radiation exposure during construction. Moreover, this construction process ensures the tube is introduced and is reliably connected to the fluid path of the generator. Further and alternative features of the radioisotope generator and of the process of construction of the generator are envisaged without departing from the scope of the present invention as claimed in the appended claims.

The invention claimed is:

1. A device for producing a fluid containing a radioactive constituent, the device comprising a shielded chamber with an opening for receiving an isotope container housing a radioactive isotope;

a chamber closure adapted for cooperating with and closing the chamber opening;

a first fluid port comprising a first hollow needle projecting into the shielded chamber from the chamber closure for fluid communication with the isotope container;

a second fluid port comprising a second hollow needle projecting into the shielded chamber from the closed end of the chamber opposite the chamber closure for fluid communication with the isotope container;

first and second compressible buffers mounted so as to surround at least partially the respective first and second hollow needles, each buffer providing an outer surface for contact with opposed ends of the isotope container; and a spacer of a predetermined thickness associated with one or each of the first and second compressible buffers for determining the positioning of the isotope container within the shielded chamber;

wherein said isotope container is an ion exchange column including a frangible seal at each of its opposing ends, said frangible seal adapted to be pierced by and to seal around the respective first and second needles.

2. A device as claimed in claim 1, wherein with the chamber closure in place in the chamber opening, the first and second hollow needles are fixed in position at each end of the shielded chamber.

3. A device as claimed in claim 1, wherein the spacer is provided with the second compressible buffer at the closed end of the shielded chamber.

4. A device as claimed in claim 1, wherein the material of the first and second compressible buffers is a semi-open cell foam.

5. A device as claimed in claim 1, wherein the material of the spacer is a closed cell foam.

6. A device as claimed in claim 1, wherein the device is a radioisotope generator.

7. A device as claimed in claim 1, wherein the isotope container is an ion exchange column.

8. A device as claimed in claim 1, wherein the first and second hollow needles are each connected via associated fluid conduits with a fluid inlet and a fluid outlet respectively.

9. A device as claimed in claim 8, wherein the fluid inlet and the fluid outlet each consists of hollow spikes.

10. A device as claimed in claim 9 wherein the device further includes an outer housing within which the shielded chamber is located wherein the fluid inlet and the fluid outlet are mounted in the outer housing to provide fluid connections external to the outer housing.

11. A device as claimed in claim 10, wherein the fluid conduits each consist of flexible tubing which is greater in length than the distance between the hollow needles and their respective fluid inlet or outlet.

12. A device as claimed in claim 11, wherein the flexible tubing of each fluid conduit is in length at least twice the distance between the hollow needles and their respective fluid inlet or outlet.

13. A method of constructing a radioisotope generator comprising the steps of:

providing a shielded chamber with an opening and a chamber closure adapted for cooperating with and closing the chamber opening;

providing a first fluid port comprising a first hollow needle projecting into the shielded chamber from the chamber closure;

providing a second fluid port comprising a second hollow needle projecting into the shielded chamber at the end of the chamber opposite the opening;

mounting first and second compressible buffers so as to surround at least partially the respective first and second hollow needles, one or each of the compressible buffers including a spacer of predetermined thickness;

thereafter introducing an isotope container housing a radioactive isotope through the chamber opening into the shielded chamber so as to contact with the second hollow needle and the second compressible buffer at the closed end of the chamber, wherein said isotope container is an ion exchange column including a frangible seal at each of its opposing ends, said frangible seal adapted to be pierced by and to seal around the respective first and second needles; and closing the shielded chamber by positioning the chamber closure in the opening and bringing the first hollow needle and the first compressible buffer into contact with the isotope container whereby the spacer determines the positioning of the isotope container within the shielded container.

14. A method as claimed in claim 13, further comprising the step of, prior to introduction of the isotope container into the shielded chamber, connecting the first hollow needle to a first fluid conduit and connecting the second hollow needle to a second fluid conduit.

15. A method as claimed in claim 14, further comprising the step of, prior to introduction of the isotope container into the shielded container, locating the shielded container within an outer housing and connecting the first fluid conduit to a fluid inlet in the outer housing and the second fluid conduit to a fluid outlet in the outer housing.

16. A method as claimed in claim 15, wherein the first and second fluid conduits are each of flexible tubing which is greater in length than the distance between the first and second hollow needles and their respective fluid inlet and fluid outlet when the chamber closure is in place in the chamber opening and the shielded chamber is positioned within the outer housing whereby all fluid connections can be established prior to installation of the isotope container within the shielded chamber.

* * * * *

UNITED STATES PATENT AND TRADEMARK OFFICE

CERTIFICATE OF CORRECTION

PATENT NO. : 7,592,605 B2
APPLICATION NO. : 10/511405
DATED : September 22, 2009
INVENTOR(S) : Weisner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 726 days.

Signed and Sealed this

Twenty-first Day of September, 2010

David J. Kappos

David J. Kappos
*Director of the United States Patent and Trademark Office*